US009741218B2

(12) United States Patent
Wen et al.

(10) Patent No.: US 9,741,218 B2
(45) **Date of Patent: *Aug. 22, 2017**

(54) EXPLICIT REAL-TIME FIRE DISASTER ALARMING DEVICE AND METHOD

(71) Applicants: NATIONAL CHUNG HSING UNIVERSITY, Taichung (TW); SHEEN WORLD TECHNOLOGY CORPORATION, Taichung (TW)

(72) Inventors: Chih-Yu Wen, Taichung (TW); Hsiao-Ping Tsai, Taichung (TW); Tai-Ming Wen, Taichung (TW); Dun-Kai Zhang, Taichung (TW); Yun-Lin Tsai, Taichung (TW)

(73) Assignees: NATIONAL CHUNG HSING UNIVERSITY, Taichung (TW); SHEEN WORLD TECHNOLOGY CORPORATION, Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 15/211,519

(22) Filed: Jul. 15, 2016

(65) Prior Publication Data

US 2017/0018154 A1 Jan. 19, 2017

(30) Foreign Application Priority Data

Jul. 16, 2015 (TW) ..... 104123140 A

(51) Int. Cl.
*G08B 7/06* (2006.01)
*G08B 17/10* (2006.01)
(Continued)

(52) U.S. Cl.
CPC ..... *G08B 7/064* (2013.01); *G08B 17/10* (2013.01); *G08B 27/001* (2013.01); *G08B 17/00* (2013.01); *G08B 21/22* (2013.01)

(58) Field of Classification Search
CPC ..... G08B 21/22; G08B 3/10; G08B 17/10; G08B 13/08; G08B 7/066; G08B 25/14; E06C 7/003; A62B 99/00
(Continued)

(56) References Cited

U.S. PATENT DOCUMENTS 5,309,146 A * 5/1994 Kenet ..... G08B 19/005 340/540
6,762,686 B1 * 7/2004 Tabe ..... G08B 25/08 340/541
(Continued)

*Primary Examiner* — George Bugg
*Assistant Examiner* — Munear Akki
(74) *Attorney, Agent, or Firm* — Muncy, Geissler, Olds & Lowe, P.C.

(57) ABSTRACT

An explicit real-time fire disaster alarming device includes a fire disaster detector, human body detector, controller and outdoor light displaying portion. If the fire disaster detector detects any fire inside a space or room, it will send out a fire signal. The human body detector detects whether there is any human inside the space and send out a YES signal or a NO signal accordingly. When the controller receives the fire signal, the outdoor light displaying portion changes from a storing form to an extending form. When the controller receives the YES signal, the outdoor light displaying portion turns on a light for showing there is a human inside the space. When it receives the NO signal, the outdoor light displaying portion turns on another light for showing there is no human inside. Hence, fire fighters and rescuers are provided with a priority reference for life rescue.

7 Claims, 8 Drawing Sheets

(51) Int. Cl.
*G08B 27/00* (2006.01)
*G08B 17/00* (2006.01)
*G08B 21/22* (2006.01)

(58) Field of Classification Search
USPC ..... 340/573.1, 540, 628, 545.3, 691.1, 506; 705/324; 182/18
See application file for complete search history.

(56) References Cited

U.S. PATENT DOCUMENTS

| | | | | |
|---|---|---|---|---|
| 7,182,174 | B2 * | 2/2007 | Parrini | B66B 5/022 182/18 |
| 2005/0174251 | A1 * | 8/2005 | Terry, III | G08B 7/062 340/691.1 |
| 2007/0176770 | A1 * | 8/2007 | Shrode | A62B 99/00 340/539.13 |
| 2009/0027225 | A1 * | 1/2009 | Farley | G08B 7/06 340/6.11 |
| 2011/0187543 | A1 * | 8/2011 | Russo | G08B 17/10 340/628 |
| 2014/0320282 | A1 * | 10/2014 | Zhang | G08B 7/066 340/502 |
| 2015/0065078 | A1 * | 3/2015 | Mejia | G08B 17/00 455/404.1 |
| 2015/0348220 | A1 * | 12/2015 | Sharma | G06Q 50/265 705/324 |

* cited by examiner

EXPLICIT REAL-TIME FIRE DISASTER ALARMING DEVICE AND METHOD

BACKGROUND OF THE INVENTION

Field of the Invention

The present invention relates to explicit real-time fire disaster alarming devices and methods and, more particularly, to an explicit real-time fire disaster alarming device and method for effectuating explicit warning to effectively enhance the efficiency of life rescue, with each apartment having its own device to thereby enhance effectiveness and variety of the device and broaden its application scope.

Description of the Prior Art

Most conventional disaster warning indicators (hereinafter exemplified by fire warning indicators) focus on reporting life-threatening incidents, creating e-maps, and planning escape routes.

However, fires often cause injuries and claim lives, because the casualties are not rescued until after the golden hour has expired. It is because, after arriving at a fire scene, rescuers are unable to determine, quickly from outside a building 93, which apartment (or room) has a trapped person 931 (as shown in FIG. 11, assuming that a fire breaks out on the second floor where three rooms are on fire, and the trapped person 931 is present in the leftmost room.) Hence, it is desirable that a disaster warning indicator not only provides information about an escape from a building on fire but also enables the outside of a building to give a clear warning as to whether any trapped persons are confined to the building so that the rescuers can rescue the trapped persons as soon as possible and reduce the casualties.

Accordingly, it is imperative to overcome the aforesaid drawbacks of the conventional disaster warning indicators.

SUMMARY OF THE INVENTION

It is an objective of the present invention to provide an explicit real-time fire disaster alarming device and method for effectuating explicit warning to effectively enhance the efficiency of life rescue, with each apartment having its own device to thereby enhance effectiveness and variety of the device and broaden its application scope. In particular, the problems to be solved in the present invention is that the conventional disaster warning indicators can not indicate whether there are any trapped persons in the building from outside of the building.

In order to achieve the above and other objectives, the present invention provides an explicit real-time fire disaster alarming device which comprises at least a fire disaster detector, at least a human body detector, at least an outdoor light displaying portion and a controller.

The at least a fire disaster detector is disposed inside a predetermined space to send out a fire signal upon detection of a fire inside the predetermined space.

The at least a human body detector is disposed inside the predetermined space to send out a YES signal and a NO signal upon detection that a human is present in and absent from the predetermined space, respectively.

The at least an outdoor light displaying portion is disposed outside the predetermined space, capable of changing between a storing form and an extending form, and adapted to face outward to display one of a YES light and a NO light while being in the extending form.

The controller connects with the fire disaster detector, the human body detector and the outdoor light displaying portion and receives the fire signal, the YES signal and the NO signal.

Therefore, after receiving the fire signal, the controller controls the outdoor light displaying portion to change from the storing form to the extending form. After receiving the YES signal, the controller controls the outdoor light displaying portion to display the YES light. After receiving the NO signal, the controller controls the outdoor light displaying portion to display the NO light. The YES light provides external rescuers with a priority reference for use in life detection and rescue operations.

The present invention further provides an explicit real-time fire disaster alarming method which comprises:

A. preparing step;

B. detecting step; and

C. explicit warning step.

The aforesaid objectives and advantages of the present invention are illustrated with preferred embodiments and depicted with accompanying drawings.

The present invention is illustrated with preferred embodiments, depicted with accompanying drawings, and described below.

DETAILED DESCRIPTION OF THE EMBODIMENT OF THE INVENTION

Figure 1:
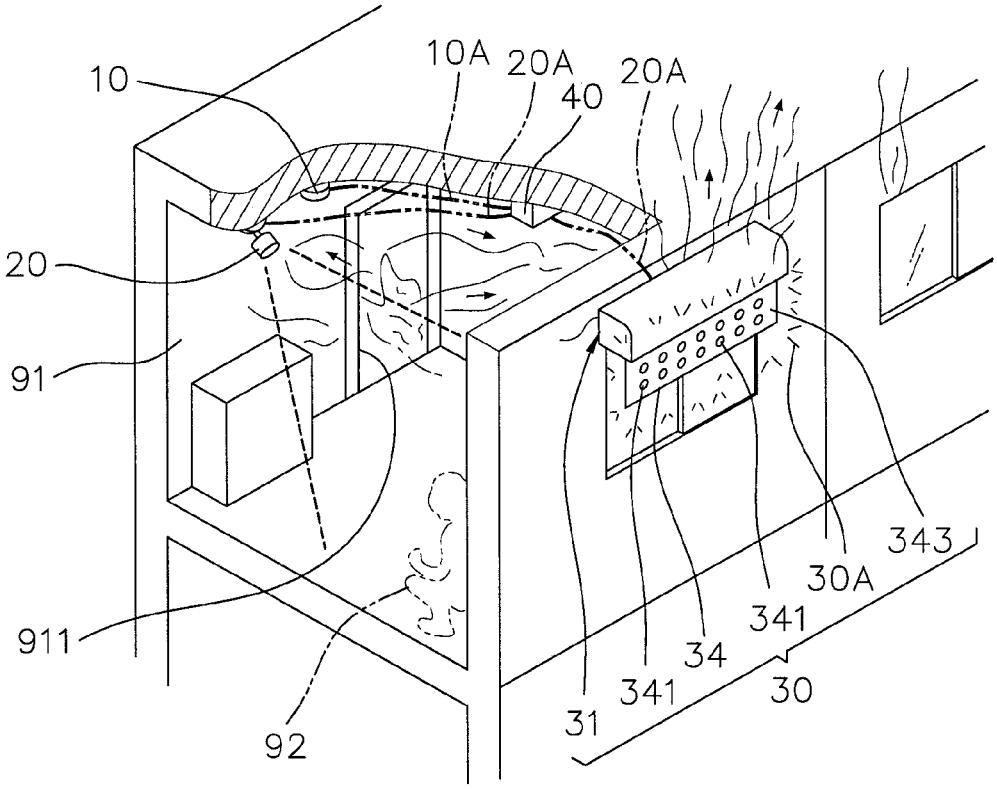
FIG. 1 is a schematic view of an embodiment of the present invention.
Figure 2:
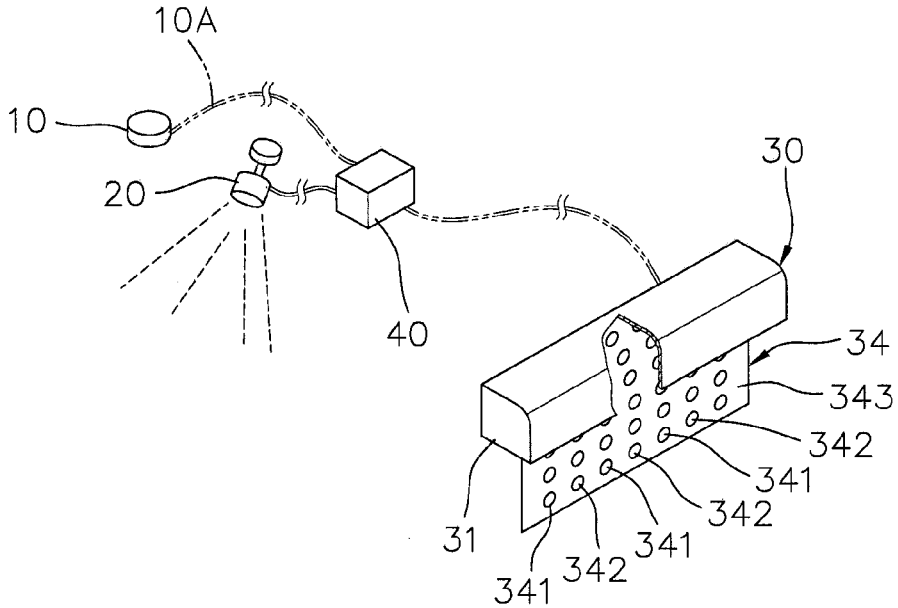
FIG. 2 is a schematic view of a main device of the present invention.
Figure 6:
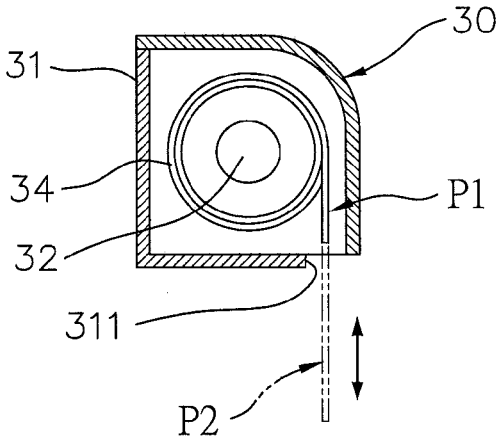
FIG. 6 is a schematic view which shows that a lamp curtain device of FIG. 5 changes between a storing form and an extending form.

Referring to FIG. 1, FIG. 2, and FIG. 6, the present invention provides an explicit real-time fire disaster alarming device which comprises at least a fire disaster detector 10, at least a human body detector 20, at least an outdoor light displaying portion 30 and a controller 40.

The at least a fire disaster detector 10 is disposed inside a predetermined space 91 to send out a fire signal 10A upon detection of a fire inside the predetermined space 91.

Figure 8:
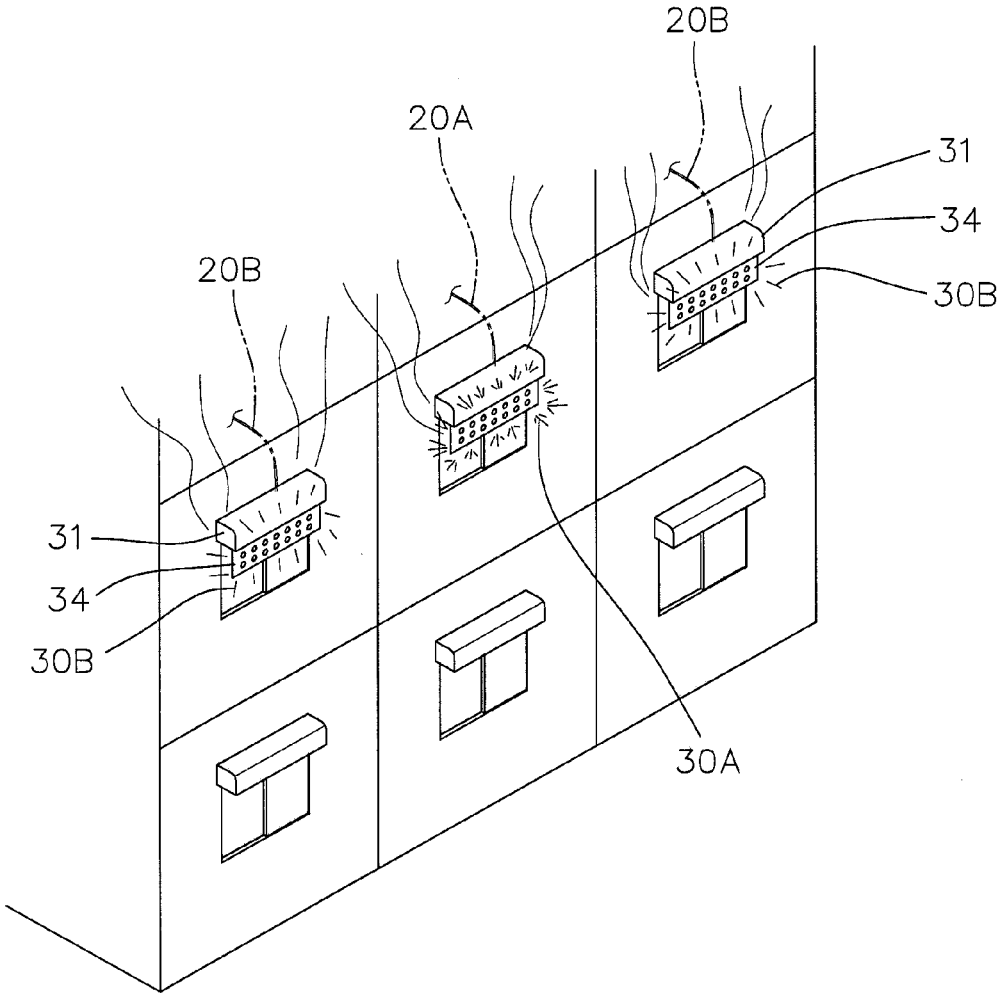
FIG. 8 is a schematic view of displaying a YES light and a NO light at a fire scene according to the present invention.

The at least a human body detector 20 is disposed inside the predetermined space 91 to send out a YES signal 20A and a NO signal 20B upon detection that a human is present in and absent from the predetermined space 91, respectively, as shown in FIG. 8.

The at least an outdoor light displaying portion 30 is disposed outside the predetermined space 91, capable of changing between a storing form P1 and an extending form P2 (as shown in FIG. 6), and adapted to face outward to display a YES light 30A or a NO light 30B while being in the extending form P2.

The controller 40 connects with the fire disaster detector 10, the human body detector 20 and the outdoor light displaying portion 30 and receives the fire signal 10A, the YES signal 20A and the NO signal 20B.

After receiving the fire signal 10A, the controller 40 controls the outdoor light displaying portion 30 to change from the storing form P1 to the extending form P2. After receiving the YES signal 30A, the controller 40 controls the outdoor light displaying portion 30 to display the YES light 30A. After receiving the NO signal 20B, the controller 40 controls the outdoor light displaying portion 30 to display the NO light 30B. The YES light 30A provides external rescuers with a priority reference for use in life detection and rescue operations.

In practice, the fire disaster detector 10 includes a well-known smoke detector and/or a rate-of-rise heat detector (for example, the rate-of-rise heat detector starts as soon as the room temperature increases by about 20° C. in 30 seconds.)

The human body detector 20 includes an infrared thermograph and/or an infrared passerby traffic counter. The infrared passerby traffic counter measures passerby traffic by transmitting and receiving infrared signals or through an infrared human body detector.

Figure 3A:
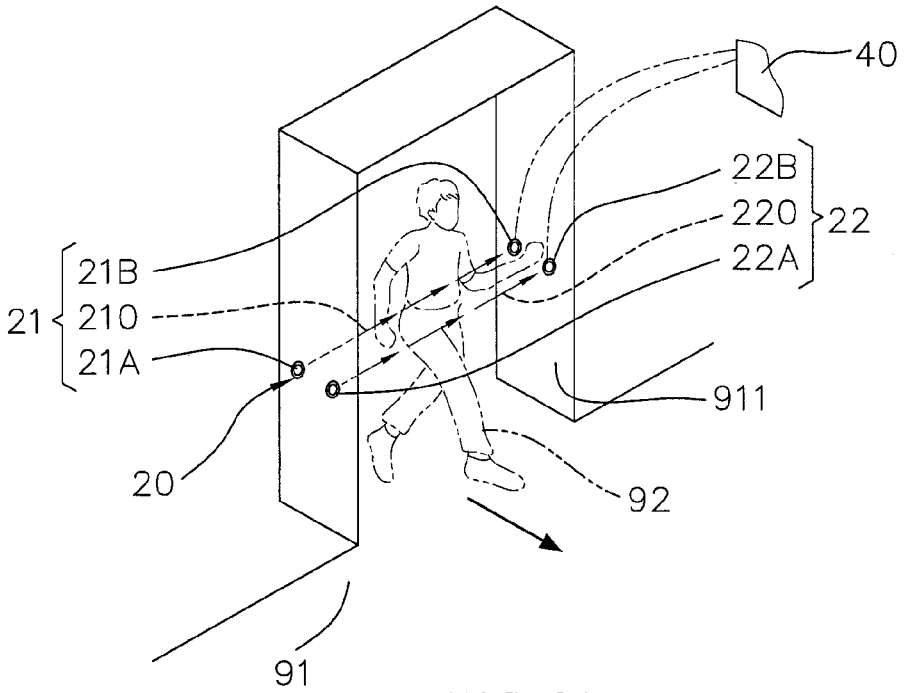
FIG. 3A is a schematic view of a human body detector for use in calculating the cumulative number of arrivals according to the present invention.

Referring to FIG. 3A, the human body detector 20 includes a first counting unit 21 and a second counting unit 22 to effectuate the infrared passerby traffic counter by transmitting and receiving infrared signals. A doorway 911 of the predetermined space 91 defines a first end of the doorway away from the predetermined space 91 and a second end of the doorway neighboring the predetermined space 91.

The first counting unit 21 is disposed at the first end of the doorway 911 of the predetermined space 91, and adapted to comprise a first transmitter 21A and a first receiver 21B corresponding in position to the first transmitter 21A. The first transmitter 21A transmits a first infrared 210 to the first receiver 21B. The first receiver 21B connects with the controller 40.

The second counting unit 22 is disposed at the second end of the doorway 911 of the predetermined space 91. The second counting unit 22 includes a second transmitter 22A and a second receiver 22B corresponding in position to the second transmitter 22A. The second transmitter 22A transmits a second infrared 220 to the second receiver 22B. The second receiver 22B connects with the controller 40.

A human body 92 entering the predetermined space 91 through the doorway 911 blocks the first infrared 210 and then blocks the second infrared 220, thereby allowing the controller 40 to calculate the number of arrivals and accordingly compute the cumulative number of arrivals. Similarly, the human body 92 exiting the predetermined space 91 through the doorway 911 (shown in FIG. 3B) blocks the second infrared 220 and then blocks the first infrared 210, thereby allowing the controller 40 to calculate the number of departures and accordingly compute the cumulative number of departures. Finally, the controller 40 subtracts the cumulative number of departures from the cumulative number of arrivals to determine whether any person is present in the predetermined space 91 and, if yes, determine the number of persons present in the predetermined space 91.

Figure 3B:
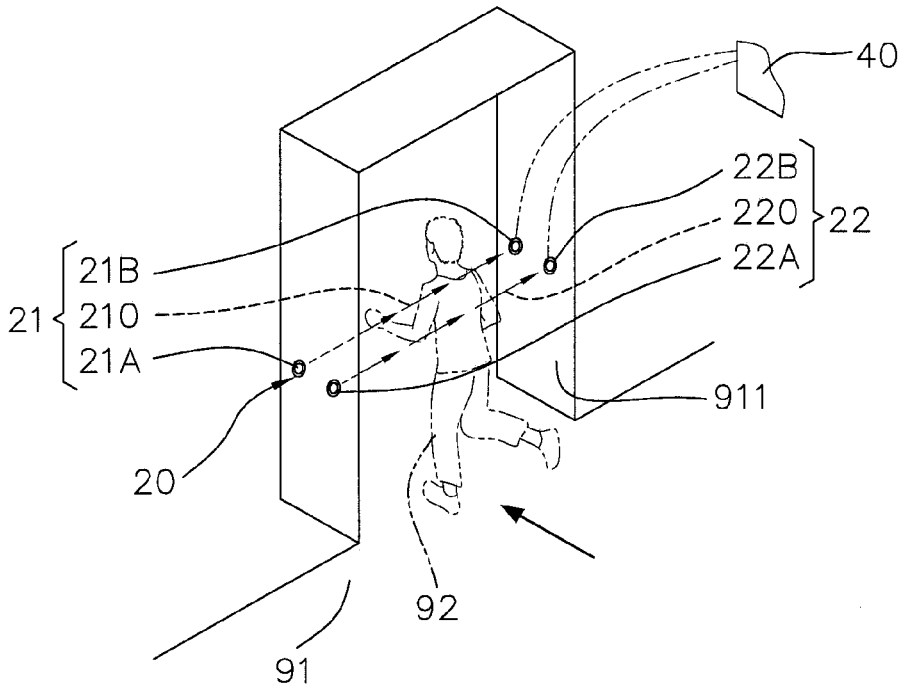
FIG. 3B is a schematic view of the human body detector for use in calculating the cumulative number of departures according to the present invention.
Figure 3C:
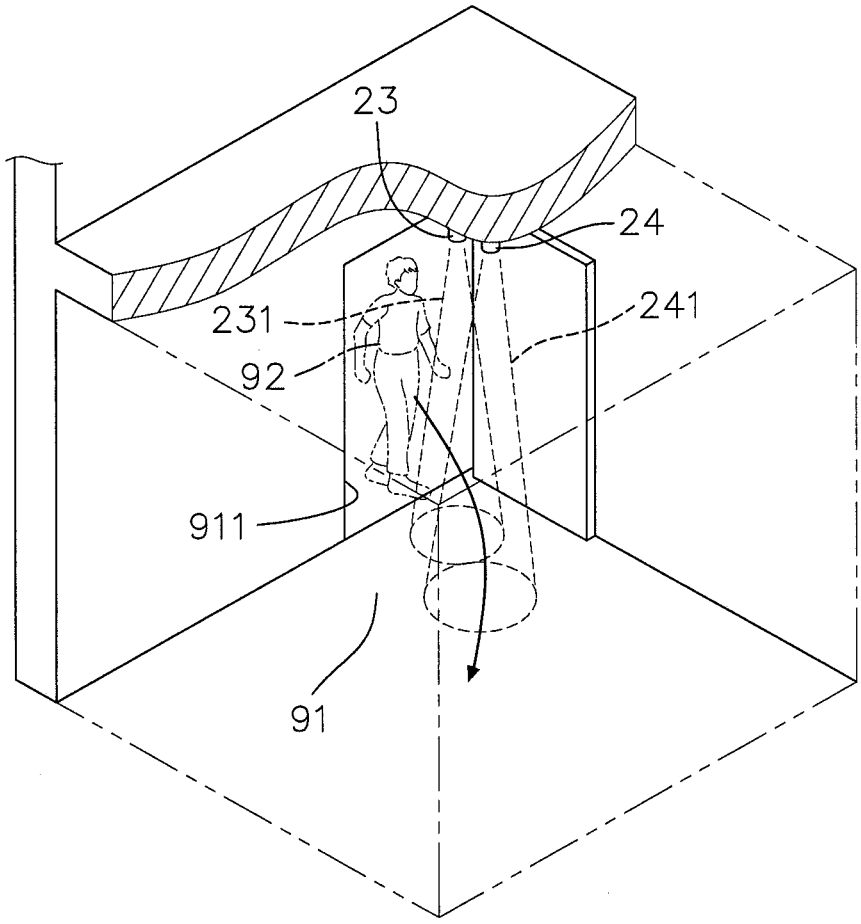
FIG. 3C is a schematic view of the human body detector for use in head counting according to another embodiment of the present invention.

Referring to FIG. 3C, when an infrared human body detector (i.e., commercially-available door sensing indicator) is used to measure passerby traffic, it includes a first sensor 23 and a second sensor 24. The first sensor 23 and the second sensor 24 are mounted above the doorway 911 of the predetermined space 91 (to face downward from the ceiling), spaced apart by a distance horizontally, and adapted to send out a first detection signal 231 and a second detection signal 241, respectively. A time lag between the first detection signal 231 and the second detection signal 241 enables the controller 40 to determine whether a person (i.e., the human body 92) enters or exits the predetermined space 91, thereby performing the aforesaid functions too.

The outdoor light displaying portion 30 is a lamp curtain.

Figure 4:
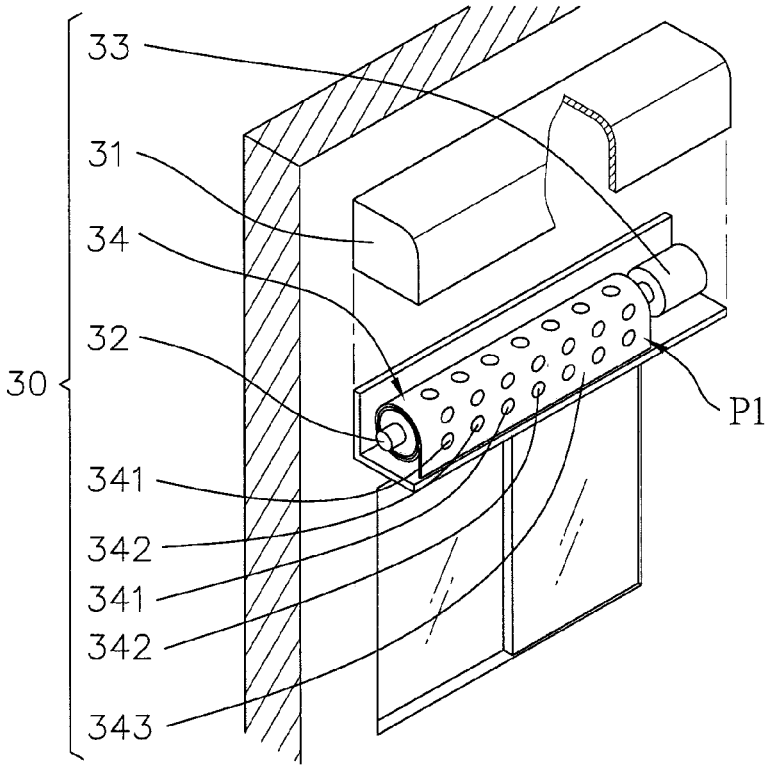
FIG. 4 is a cutaway view of an outdoor light displaying portion according to the present invention.
Figure 5:
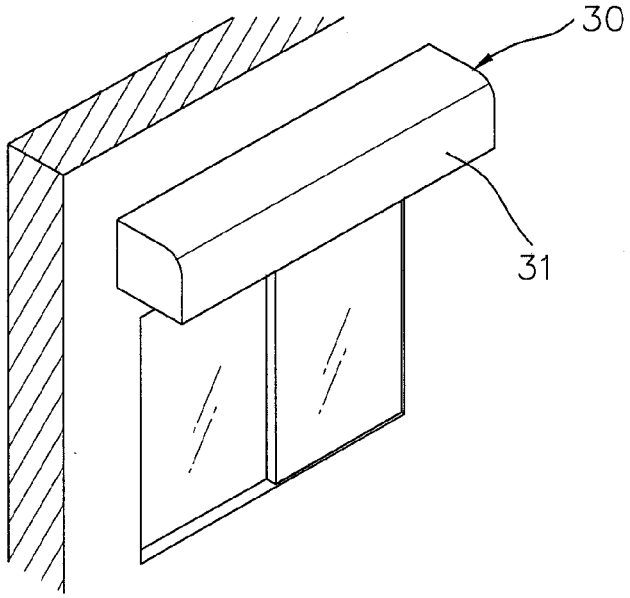
FIG. 5 is a schematic view of completion of assembly of FIG. 4.
Figure 7:
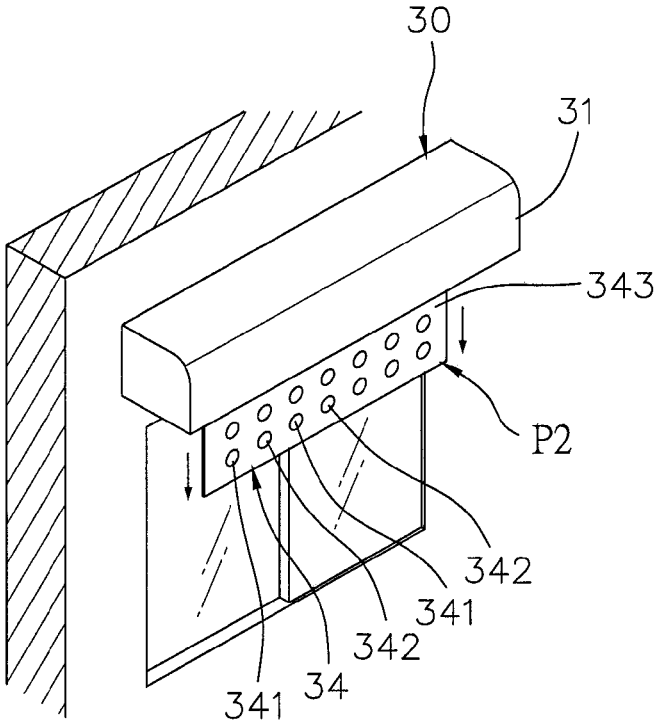
FIG. 7 is a schematic view which shows that the lamp curtain device of FIG. 6 is in the extending form.
Figure 9:
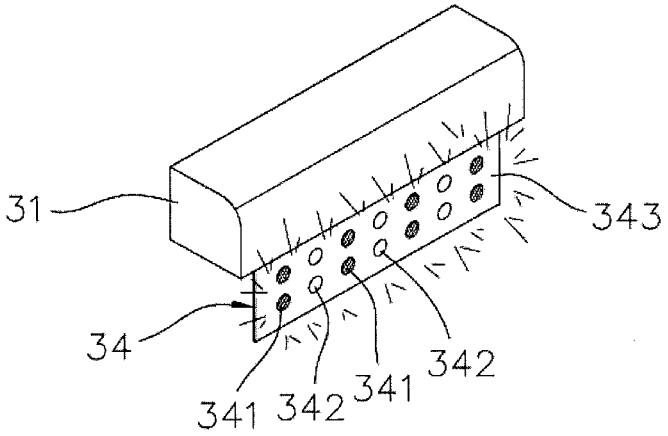
FIG. 9 is a partial enlarged view of FIG. 8.

Referring to FIG. 4, FIG. 5, and FIG. 9, the lamp curtain comprises a casing 31, a reel 32, a driving device 33 and a lamp curtain device 34. The casing 31 has an opening 311 (shown in FIG. 6). The reel 32 is disposed in the casing 31. The driving device 33 is coaxially coupled to the reel 32 to drive the reel 32 to rotate clockwise and counterclockwise. The lamp curtain device 34 has a plurality of YES lamp elements 341, a plurality of NO lamp elements 342 and a curtain element 343. The plurality of YES lamp elements 341 and the plurality of NO lamp elements 342 are each fixed to the curtain element 343. The curtain element 343 winds around the reel 32 and rotates clockwise and counterclockwise together with the reel 32, so as to change between the storing form P1 (as shown in FIG. 4) and the extending form P2 (as shown in FIG. 6 and FIG. 7). The curtain element 343 enters and exits the casing 31 through the opening 311 and thus changes between the storing form P1 and the extending form P2.

When the outdoor light displaying 30 starts, the controller 40 controls how the flickering of the YES lamp elements 341 of the outdoor light displaying 30 to indicate the number of trapped persons, for example, flashing thrice (indicative of three persons), continuous lighting for three seconds, . . . , flashing thrice (indicative of three persons), continuous lighting for three seconds.

Each predetermined space 91 has its own explicit real-time fire disaster alarming device of the present invention. For instance, assuming that an apartment building with elevators has nine floors, five apartments per floor (assuming that each apartment has only one window), and thus 45 apartments in total; hence, 45 explicit real-time fire disaster alarming devices of the present invention are independently installed in the 45 apartments, respectively. Therefore, if the explicit real-time fire disaster alarming device of any one apartment malfunctions, the 44 other explicit real-time fire disaster alarming devices of the 44 other apartments will remain unaffected.

Figure 10:
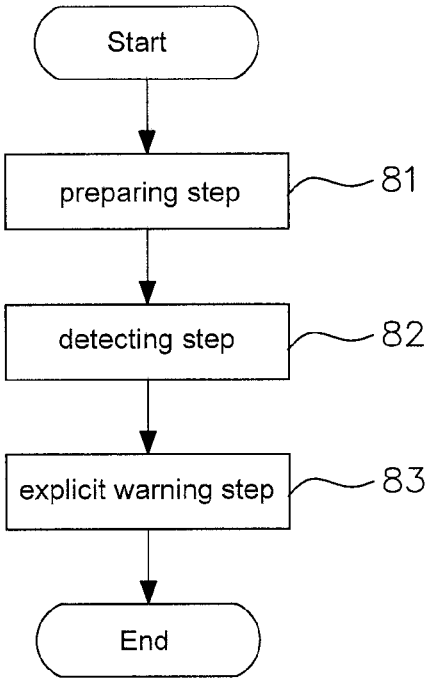
FIG. 10 is a flowchart of a method of the present invention.
Figure 11:
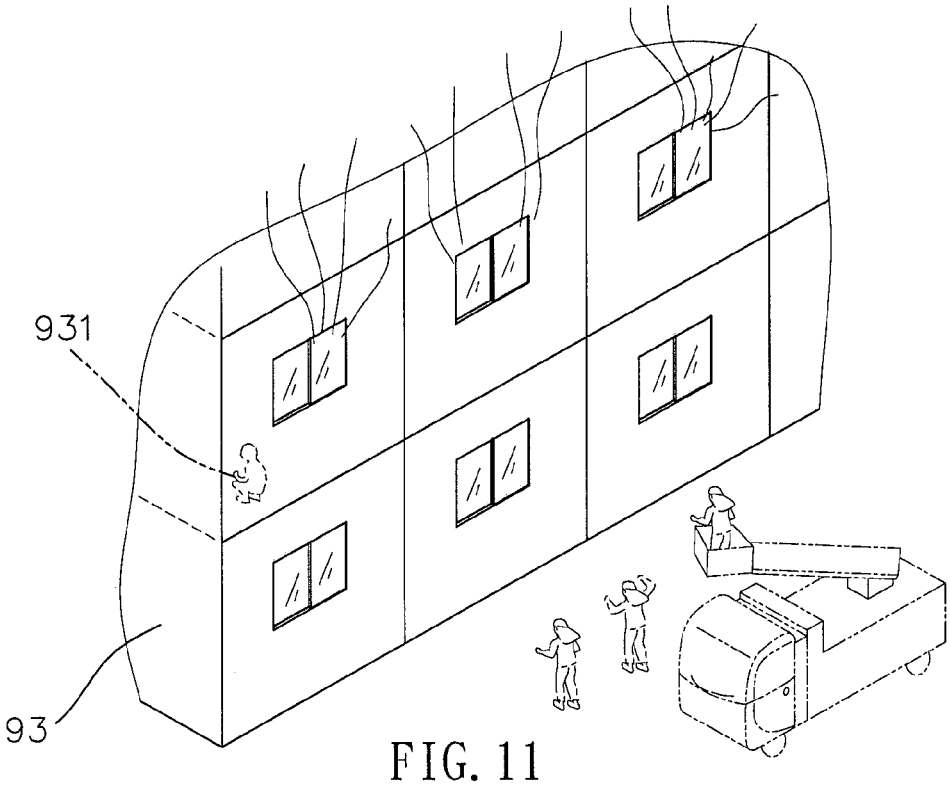
FIG. 11 is a schematic view of a conventional fire scene where it is impossible to determine whether apartment has a trapped person.

Referring to FIG. 10, the method of the present invention comprises the steps below.

A. preparing step 81: providing a fire disaster detector 10, at least a human body detector 20, at least an outdoor light displaying portion 30 and a controller 40 (shown in FIG. 1 and FIG. 2), positioning the fire disaster detector 10 and the human body detector 20 inside a predetermined space 91, allowing the outdoor light displaying portion 30 to be disposed outside the predetermined space 91 and change between a storing form P1 and an extending form P2 (as shown in FIG. 6), and connecting the controller 40 to the fire disaster detector 10, the human body detector 20 and the outdoor light displaying portion 30;

B. detecting step 82: sending out a fire signal 10A from the fire disaster detector 10 as soon as the fire disaster detector 10 detects a fire inside the predetermined space 91, and sending out a YES signal 20A and a NO signal 20B from the human body detector 20 as soon as the human body detector 20 detects that a human is present in and absent from the predetermined space 91, respectively (shown in FIG. 8); and C. explicit warning step 83: controlling, by the controller 40, the outdoor light displaying portion 30 to change from the storing form P1 to the extending form P2 as soon as the controller 40 receives the fire signal 10A, and controlling, by the controller 40, the outdoor light displaying portion 30 to display one of a YES light 30A and a NO light 30B in response to the YES signal 20A and the NO signal 20B, respectively, with the YES light 30A providing external rescuers with a priority reference for use in life detection and rescue operations.

The fire disaster detector 10 includes a well-known smoke detector and/or a rate-of-rise heat detector (for example, the rate-of-rise heat detector starts as soon as the room temperature increases by about 20° C. in 30 seconds.)

The human body detector 20 includes an infrared thermograph and/or an infrared passerby traffic counter. The infrared passerby traffic counter measures passerby traffic by transmitting and receiving infrared signals or through an infrared human body detector.

Referring to FIG. 3A, when the passerby traffic is measured with the infrared passerby traffic counter by transmitting and receiving infrared signals, the human body detector 20 includes a first counting unit 21 and a second counting unit 22. A doorway 911 of the predetermined space 91 defines a first end of the doorway away from the predetermined space 91 and a second end of the doorway neighboring the predetermined space 91.

The first counting unit 21 is disposed at the first end of the doorway 911 of the predetermined space 91. The first counting unit 21 includes a first transmitter 21A and a first receiver 21B corresponding in position to the first transmitter 21A. The first transmitter 21A transmits a first infrared 210 to the first receiver 21B. The first receiver 21B connects with the controller 40.

The second counting unit 22 is disposed at the second end of the doorway 911 of the predetermined space 91. The second counting unit 22 includes a second transmitter 22A and a second receiver 22B corresponding in position to the second transmitter 22A. The second transmitter 22A transmits a second infrared 220 to the second receiver 22B. The second receiver 22B connects with the controller 40.

A human body 92 entering the predetermined space 91 through the doorway 911 blocks the first infrared 210 and then blocks the second infrared 220, thereby allowing the controller 40 to calculate the number of arrivals and accordingly compute the cumulative number of arrivals. Similarly, the human body 92 exiting the predetermined space 91 through the doorway 911 (as shown in FIG. 3B) blocks the second infrared 220 and then blocks the first infrared 210, thereby allowing the controller 40 to calculate the number of departures and accordingly compute the cumulative number of departures. Finally, the controller 40 subtracts the cumulative number of departures from the cumulative number of arrivals to determine whether any person is present in the predetermined space 91 and, if yes, determine the number of persons present in the predetermined space 91.

Referring to FIG. 3C, when an infrared human body detector (i.e., commercially-available door sensing indicator) is used to measure passerby traffic, it includes a first sensor 23 and a second sensor 24. The first sensor 23 and the second sensor 24 are mounted above the doorway 911 of the predetermined space 91 (to face downward from the ceiling), spaced apart by a distance horizontally, and adapted to send out a first detection signal 231 and a second detection signal 241, respectively. A time lag between the first detection signal 231 and the second detection signal 241 enables the controller 40 to determine whether a person (i.e., the human body 92) enters or exits the predetermined space 91, thereby performing the aforesaid functions too.

The outdoor light displaying portion 30 is a lamp curtain.

Referring to FIG. 4, FIG. 5, and FIG. 9, the lamp curtain comprises a casing 31, a reel 32, a driving device 33, and a lamp curtain device 34. The casing 31 has an opening 311 (shown in FIG. 6). The reel 32 is disposed in the casing 31. The driving device 33 is coaxially coupled to the reel 32 to drive the reel 32 to rotate clockwise and counterclockwise. The lamp curtain device 34 has a plurality of YES lamp elements 341, a plurality of NO lamp elements 342 and a curtain element 343. The plurality of YES lamp elements 341 and the plurality of NO lamp elements 342 are each fixed to the curtain element 343. The curtain element 343 winds around the reel 32, rotates clockwise and counterclockwise together with the reel 32, and changes between the storing form P1 (shown in FIG. 4) and the extending form P2 (as shown in FIG. 6 and FIG. 7.) The curtain element 343 enters and exits the casing 31 through the opening 311 and thus changes between the storing form P1 and the extending form P2.

When the outdoor light displaying 30 starts, the controller 40 controls how the flickering of the YES lamp elements 341 of the outdoor light displaying 30 to indicate the number of trapped persons, for example, flashing thrice (indicative of three persons), continuous lighting for three seconds, . . . , flashing thrice (indicative of three persons), continuous lighting for three seconds.

A single explicit real-time fire disaster alarming device of the present invention is dedicated to each predetermined space 91 and optionally coupled to a collective electric power supply or central system of an apartment building with elevators (so as for the controller 40 in each apartment to send a warning to the central system.) For instance, assuming that an apartment building with elevators has nine floors, five apartments per floor, and thus 45 apartments in total; hence, 45 explicit real-time fire disaster alarming devices of the present invention are independently installed in the 45 apartments, respectively. Therefore, the 44 other explicit real-time fire disaster alarming devices of the 44 other apartments remain unaffected in any of the following circumstances: the explicit real-time fire disaster alarming device of any one apartment malfunctions; an interruption happens to collective electric power supply to an apartment building with elevators; and the central system malfunctions.

The advantages and effects of an explicit real-time fire disaster alarming device of the present invention are as follows:

[1] Explicit warning is effective in enhancing the efficiency of life rescue. As soon as a fire breaks out at an apartment building, one of the explicit real-time fire disaster alarming devices mounted on the apartment building and facing outward displays conspicuously a YES light indicative of a trapped person and thus dispenses rescuers with the need to search apartments of the apartment building one by one for the trapped person. Hence, explicit warning enhances the efficiency of life rescue effectively.

[2] Each apartment has its own device to therefore enhance the effectiveness of the devices. The devices disposed in the apartments, respectively, are independent of each other; hence, the devices of the apartment building with elevators will still be operating, even if the apartment building with elevators has its collective electric power supply interrupted or central system damaged. Therefore, each apartment has its own device to therefore enhance the effectiveness of the devices.

[3] Great Variety and Wide Application Scope. The outdoor light displaying portion of the present invention is a lamp curtain, which can be combined with conventional curtains of apartment buildings. Therefore, the explicit real-time fire disaster alarming devices have great variety and wide application scope.

The aforesaid preferred embodiments illustrate the present invention. No simple amendment and change made to the embodiments departs from the spirit and scope of the present invention.

What is claimed is:

1. An explicit real-time fire disaster alarming device, comprising:

at least a fire disaster detector disposed inside a predetermined space to send out a fire signal upon detection of a fire inside the predetermined space;

at least a human body detector disposed inside the predetermined space to send out a YES signal and a NO signal upon detection that a human is present in and absent from the predetermined space, respectively;

at least an outdoor light displaying portion disposed outside the predetermined space, capable of changing between a storing form and an extending form, and adapted to face outward to display one of a YES light and a NO light while being in the extending form; and a controller connecting with the fire disaster detector, the human body detector and the outdoor light displaying portion and receiving the fire signal, the YES signal and the NO signal, wherein, after receiving the fire signal, the controller controls the outdoor light displaying portion to change from the storing form to the extending form, wherein, after receiving the YES signal, the controller controls the outdoor light displaying portion to display the YES light, wherein, after receiving the NO signal, the controller controls the outdoor light displaying portion to display the NO light, wherein the YES light provides external rescuers with a priority reference for use in life detection and rescue operations;

wherein:

the fire disaster detector comprises at least one of a smoke detector and a rate-of-rise heat detector; and the human body detector comprises at least one of an infrared thermograph and an infrared passerby traffic counter;

wherein the infrared passerby traffic counter measures passerby traffic by transmitting and receiving infrared signals or through an infrared human body detector;

wherein a doorway of the predetermined space defining a first end of the doorway away from the predetermined space and a second end of the doorway neighboring the predetermined space;

wherein, when the passerby traffic is measured by transmitting and receiving infrared signals, it comprises:

a first counting unit disposed at the first end of the doorway, and adapted to comprise a first transmitter and a first receiver corresponding in position to the first transmitter, the first transmitter transmitting a first infrared to the first receiver, and the first receiver connecting with the controller;

a second counting unit disposed at the second end of the doorway, and adapted to comprise a second transmitter and a second receiver corresponding in position to the second transmitter, the second transmitter transmitting a second infrared to the second receiver, and the second receiver connecting with the controller;

wherein a human body entering the predetermined space through the doorway blocks the first infrared and then blocks the second infrared, thereby allowing the controller to calculate number of arrivals and accordingly compute cumulative number of arrivals, wherein the human body exiting the predetermined space through the doorway blocks the second infrared and then blocks the first infrared, thereby allowing the controller to calculate number of departures and accordingly compute cumulative number of departures, wherein, finally, the controller subtracts the cumulative number of departures from the cumulative number of arrivals to determine whether any person is present in the predetermined space and, if yes, determine number of persons present in the predetermined space;

wherein, when an infrared human body detector is used to measure passerby traffic, it comprises a first sensor and a second sensor which are mounted above the doorway of the predetermined space to face downward, spaced apart by a distance horizontally, and adapted to send out a first detection signal and a second detection signal, respectively, wherein a time lag between the first detection signal and the second detection signal enables the controller to determine whether the human body enters or exits the predetermined space, thereby calculating the cumulative number of persons present in the predetermined space.

2. The explicit real-time fire disaster alarming device of claim 1, wherein the outdoor light displaying portion is a lamp curtain.

3. The explicit real-time fire disaster alarming device of claim 2, wherein the lamp curtain comprises:

a casing having an opening;

a reel disposed in the casing;

a driving device coaxially coupled to the reel to drive the reel to rotate clockwise and counterclockwise; and a lamp curtain device having a plurality of YES lamp elements, a plurality of NO lamp elements and a curtain element, wherein the plurality of YES lamp elements and the plurality of NO lamp elements are each fixed to the curtain element, with the curtain element winding around the reel, rotating clockwise and counterclockwise together with the reel, and changing between the storing form and the extending form, wherein the curtain element enters and exits the casing through the opening and thereby changes between the storing form and the extending form.

4. The explicit real-time fire disaster alarming device of claim 3, wherein:

the controller controls number of times the YES lamp elements flicker to indicate number of trapped persons.

5. An explicit real-time fire disaster alarming method, comprising:

preparing step: providing a fire disaster detector, at least a human body detector, at least an outdoor light displaying portion and a controller, positioning the fire disaster detector and the human body detector inside a predetermined space, allowing the outdoor light displaying portion to be disposed outside the predetermined space and change between a storing form and an extending form, and connecting the controller to the fire disaster detector, the human body detector and the outdoor light displaying portion;

detecting step: sending out a fire signal from the fire disaster detector as soon as the fire disaster detector detects a fire inside the predetermined space, and sending out a YES signal and a NO signal from the human body detector as soon as the human body detector detects that a human is present in and absent from the predetermined space, respectively; and explicit warning step: controlling, by the controller, the outdoor light displaying portion to change from the storing form to the extending form as soon as the controller receives the fire signal, and controlling, by the controller, the outdoor light displaying portion to display one of a YES light and a NO light in response to the YES signal and the NO signal, respectively, with the YES light providing external rescuers with a priority reference for use in life detection and rescue operations;

wherein:

the fire disaster detector comprises at least one of a smoke detector and a rate-of-rise heat detector;

the human body detector comprises at least one of an infrared thermograph and an infrared passerby traffic counter;

the infrared passerby traffic counter measures passerby traffic by transmitting and receiving infrared signals or through an infrared human body detector;

wherein a doorway of the predetermined space defining a first end of the doorway away from the predetermined space and a second end of the doorway neighboring the predetermined space;

wherein, when the passerby traffic is measured by transmitting and receiving infrared signals, it comprises:

a first counting unit disposed at the first end of the doorway, and adapted to comprise a first transmitter and a first receiver corresponding in position to the first transmitter, the first transmitter transmitting a first infrared to the first receiver, and the first receiver connecting with the controller;

a second counting unit disposed at the second end of the doorway, and adapted to comprise a second transmitter and a second receiver corresponding in position to the second transmitter, the second transmitter transmitting a second infrared to the second receiver, and the second receiver connecting with the controller;

wherein a human body entering the predetermined space through the doorway blocks the first infrared and then blocks the second infrared, thereby allowing the controller to calculate number of arrivals and accordingly compute cumulative number of arrivals, wherein the human body exiting the predetermined space through the doorway blocks the second infrared and then blocks the first infrared, thereby allowing the controller to calculate number of departures and accordingly compute cumulative number of departures, wherein, finally, the controller subtracts the cumulative number of departures from the cumulative number of arrivals to determine whether any person is present in the predetermined space and, if yes, determine number of persons present in the predetermined space, wherein, when an infrared human body detector is used to measure passerby traffic, it comprises a first sensor and a second sensor which are mounted above the doorway of the predetermined space to face downward, spaced apart by a distance horizontally, and adapted to send out a first detection signal and a second detection signal, respectively, wherein a time lag between the first detection signal and the second detection signal enables the controller to determine whether the human body enters or exits the predetermined space, thereby calculating the cumulative number of persons present in the predetermined space.

6. The explicit real-time fire disaster alarming method of claim 5, wherein the outdoor light displaying portion is a lamp curtain, wherein the lamp curtain comprises:

a casing having an opening;

a reel disposed in the casing;

a driving device coaxially coupled to the reel to drive the reel to rotate clockwise and counterclockwise; and a lamp curtain device having a plurality of YES lamp elements, a plurality of NO lamp elements and a curtain element, wherein the plurality of YES lamp elements and the plurality of NO lamp elements are each fixed to the curtain element, with the curtain element winding around the reel, rotating clockwise and counterclockwise together with the reel, and changing between the storing form and the extending form, wherein the curtain element enters and exits the casing through the opening and thereby changes between the storing form and the extending form.

7. The explicit real-time fire disaster alarming device of claim 6, wherein:

the controller controls number of times the YES lamp elements flicker to indicate number of trapped persons.

* * * * *